US011162038B2

(12) United States Patent
Abudawoud et al.

(10) Patent No.: US 11,162,038 B2
(45) Date of Patent: Nov. 2, 2021

(54) CONVERSION OF CRUDE OIL TO AROMATIC AND OLEFINIC PETROCHEMICALS

(71) Applicant: Saudi Arabian Oil Company, Dhahran (SA)

(72) Inventors: Raed Abudawoud, Al-Khobar (SA); Thamer Mohammad, Dhahran (SA); Alberto Lozano Ballesteros, Dhahran (SA); Essam Al Sayed, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/079,757

(22) Filed: Oct. 26, 2020

(65) Prior Publication Data

US 2021/0040403 A1 Feb. 11, 2021

Related U.S. Application Data

(62) Division of application No. 15/845,557, filed on Dec. 18, 2017, now Pat. No. 10,844,296.

(60) Provisional application No. 62/442,056, filed on Jan. 4, 2017.

(51) Int. Cl.

| | |
|---|---|
| ***C10G 69/06*** | (2006.01) |
| ***C10G 67/04*** | (2006.01) |
| ***C10G 69/14*** | (2006.01) |
| ***C10G 55/08*** | (2006.01) |
| ***C10G 67/00*** | (2006.01) |

(52) U.S. Cl.

CPC ..... *C10G 69/06* (2013.01); *C10G 55/08* (2013.01); *C10G 67/00* (2013.01); *C10G 67/04* (2013.01); *C10G 69/14* (2013.01); *C10G 2400/20* (2013.01); *C10G 2400/30* (2013.01)

(58) Field of Classification Search

CPC ..... C10G 69/06; C10G 69/08; C10G 69/10; C10G 67/04; C10G 2400/20; C10G 2400/30; B01J 8/04

See application file for complete search history.

(56) References Cited

U.S. PATENT DOCUMENTS

| | | | |
|---|---|---|---|
| 2,614,066 | A | 10/1952 | Cornell |
| 2,910,426 | A | 10/1959 | Gluesenkamp |
| 3,409,540 | A | 11/1968 | Gould et al. |

(Continued)

FOREIGN PATENT DOCUMENTS

| | | |
|---|---|---|
| CN | 101899325 | 12/2010 |
| CN | 104334694 | 2/2015 |

(Continued)

OTHER PUBLICATIONS

GCC Examination Report issued in Gulf Cooperation Council Appln. No. 2018-34569, dated Sep. 15, 2020, 5 pages.

(Continued)

*Primary Examiner* — Lessanework Seifu

(74) *Attorney, Agent, or Firm* — Fish & Richardson P.C.

(57) ABSTRACT

A system includes a hydroprocessing zone configured to remove impurities from crude oil; a first separation unit configured to separate a liquid output from the hydroprocessing zone into a light fraction and a heavy fraction; an aromatic extraction subsystem configured to extract aromatic petrochemicals from the light fraction; and a pyrolysis section configured to crack the heavy fraction into multiple olefinic products.

18 Claims, 2 Drawing Sheets

(56) References Cited

U.S. PATENT DOCUMENTS

| | | | |
|---|---|---|---|
| 3,533,938 | A | 10/1970 | Arnold |
| 3,702,292 | A | 11/1972 | Burich |
| 3,726,789 | A | 4/1973 | Kovach |
| 4,426,276 | A | 1/1984 | Dean et al. |
| 4,786,400 | A | 11/1988 | Farnsworth |
| 5,091,351 | A | 2/1992 | Murakawa et al. |
| 5,108,581 | A | 4/1992 | Aldridge |
| 9,096,806 | B2 | 8/2015 | Abba et al. |
| 9,255,230 | B2 | 2/2016 | Shafi et al. |
| 9,279,088 | B2 | 3/2016 | Shafi et al. |
| 9,284,497 | B2 | 3/2016 | Bourane et al. |
| 9,284,502 | B2 | 3/2016 | Bourane et al. |
| 9,296,961 | B2 | 3/2016 | Shafi et al. |
| 10,851,316 | B2 | 12/2020 | Abudawoud et al. |
| 2005/0211603 | A1 | 9/2005 | Guillaume et al. |
| 2008/0011644 | A1 | 1/2008 | Dean et al. |
| 2008/0011645 | A1 | 1/2008 | Dean |
| 2008/0194900 | A1 | 8/2008 | Bhirud |
| 2010/0089795 | A1 | 4/2010 | Fujiyama et al. |
| 2011/0083996 | A1 | 4/2011 | Shafi et al. |
| 2011/0247500 | A1 | 10/2011 | Akhras et al. |
| 2013/0220884 | A1 | 8/2013 | Bourane et al. |
| 2013/0233766 | A1 | 9/2013 | Shafi et al. |
| 2013/0248419 | A1 | 9/2013 | Abba |
| 2016/0264886 | A1 | 9/2016 | Davydov |
| 2021/0040402 | A1 | 2/2021 | Abudawoud et al. |

FOREIGN PATENT DOCUMENTS

| | | |
|---|---|---|
| CN | 105001908 | 10/2015 |
| WO | WO 2000009633 | 2/2000 |
| WO | WO 2009073436 | 6/2009 |
| WO | WO 2010009077 | 1/2010 |
| WO | WO 2010009082 | 1/2010 |
| WO | WO 2010009089 | 1/2010 |
| WO | WO 2013142609 | 9/2013 |
| WO | WO 2015128045 | 9/2013 |

OTHER PUBLICATIONS

GCC Examination Report in Gulf Cooperation Council Appln. No. GC 2018-39251, dated Feb. 9, 2021, 5 pages.

GCC Examination Report issued in Gulf Cooperation Council Application No. 2018-34568 dated Aug. 22, 2019, 4 pages.

GCC Examination Report issued in Gulf Cooperation Council Application No. 2018-34568 dated Dec. 22, 2019, 6 pages.

GCC Examination Report issued in Gulf Cooperation Council Application No. 2018-34569 dated Nov. 26, 2019, 4 pages.

GCC Examination Report issued in Gulf Cooperation Council Application No. 2018-39251 dated Jun. 1, 2020, 4 pages.

PCT International Search Report and Written Opinion in International Application No. PCT/US2017/067808 dated Mar. 12, 2018, 13 pages.

PCT International Search Report and Written Opinion in International Application No. PCT/US2017/067667 dated Apr. 9, 2018, 14 pages.

EPO Communication Pursuant to Article 94(3) EPC issued in European Application No. 17835759.6 dated Aug. 7, 2020, 5 pages.

GCC Examination Report in Gulf Cooperation Council Appln. No. GC 2018-34569, dated Mar. 30, 2021, 3 pages.

GCC Examination Report in Gulf Cooperation Council Appln. No. GC 2018-34568, dated Dec. 30, 2020, 3 pages.

CN Office Action issued in Chinese Appln. No. 201780086495.6, dated Feb. 4, 2021, 17 pages, with English Translation.

CN Office Action issued in Chinese Appln. No. 201780085661.0, dated Feb. 3, 2021, 22 pages, with English Translation.

EP Communication Pursuant to Article 94(3) EPC issued in European Appln. No. 17835759.6, dated Feb. 25, 2021, 5 pages.

CONVERSION OF CRUDE OIL TO AROMATIC AND OLEFINIC PETROCHEMICALS

CLAIM OF PRIORITY

This application is a divisional of and claims the benefit of U.S. application Ser. No. 15/845,557 filed on Dec. 18, 2017, which in turn claims priority to U.S. Patent Application Ser. No. 62/442,056, filed on Jan. 4, 2017. The entire contents of both previous applications are incorporated herein by reference.

BACKGROUND

Olefins (such as ethylene, propylene, butylene, and butane) and aromatics (such as benzene, toluene, and xylene) are basic intermediates that are widely used in the petrochemical and chemical industries. Thermal cracking, or steam pyrolysis, is sometimes used to form olefins and aromatics from feedstocks such as petroleum gases and distillates such as naphtha, kerosene, and gas oil.

SUMMARY

In an aspect, a system includes a hydroprocessing zone configured to remove impurities from crude oil; a first separation unit configured to separate a liquid output from the hydroprocessing zone into a light fraction and a heavy fraction; an aromatic extraction subsystem configured to extract aromatic petrochemicals from the light fraction; and a pyrolysis section configured to crack the heavy fraction into multiple olefinic products.

Embodiments can include one or more of the following features.

The aromatic extraction subsystem includes an aromatic extraction unit configured to separate aromatic petrochemicals of the light fraction from other components of the light fraction by one or more of solvent extraction and extractive distillation.

The aromatic extraction subsystem includes a reformer configured to convert the light fraction into a reformate, and in which the aromatic extraction unit is configured to receive the reformate.

The reformate is rich in aromatic petrochemicals compared to the light fraction.

The aromatic extraction subsystem includes a second separation unit configured separate an output from the reformer into the reformate and a byproduct fraction.

The system includes a gas separation unit configured to separate the byproduct fraction into hydrogen and light gases.

The hydrogen is provided to the hydroprocessing zone.

The light gases are provided to the pyrolysis section.

The reformer is configured to convert the light fraction into the reformate by one or more of hydrocracking, isomerization, dehydrocyclization, and dehydrogenation.

The reformer includes a catalyst configured to catalyze production of aromatic petrochemicals.

The other components of the light fraction are returned to the hydroprocessing zone.

The aromatic extraction unit is configured to receive the light fraction from the second separation unit and to generate an output stream that is rich in aromatics compared to the light fraction.

The aromatic extraction subsystem includes a reformer configured to convert the output stream into a reformate, and in which the aromatic extraction unit is configured to receive the reformate.

The system includes a third separation zone configured to separate an input stream of crude oil into a light crude oil fraction and a heavy crude oil fraction, in which the hydroprocessing zone is configured to remove impurities from the heavy crude oil fraction.

The light crude oil fraction is provided to the pyrolysis section.

The system includes a fourth separation zone configured to separate an effluent from the hydroprocessing zone into a gas output from the hydroprocessing zone and the liquid output from the hydroprocessing zone.

The system includes a gas separation unit configured to separate a gas output from the hydroprocessing zone into hydrogen and light gases.

The hydrogen is provided to the hydroprocessing zone.

The light gases are provided to the pyrolysis section.

The system includes a fifth separation zone configured to remove fuel oil from the heavy fraction, the fifth separation zone positioned upstream of the pyrolysis unit.

The first separation zone includes a flash separation device.

The first separation zone includes a separation device that physically or mechanically separates vapor from liquid.

The pyrolysis section includes a steam pyrolysis unit.

The pyrolysis section is configured to crack the heavy fraction into one or more of methane, ethylene, propylene, butadiene, and butene.

The hydroprocessing zone includes one or more of (i) a hydrodemetallization catalyst and (ii) a catalyst having one or more of hydrodearomatization, hydrodenitrogenation, hydrodesulfurization, and hydrocracking functions.

The system includes a purification unit configured to separate the cracked heavy fraction into multiple streams, each stream corresponding to one of the multiple products.

In an aspect, a method includes removing impurities from crude oil by a hydroprocessing process; separating a liquid output from the hydroprocessing process into a light fraction and a heavy fraction; extracting aromatic petrochemicals from the light fraction; and cracking the heavy fraction into multiple olefinic products by a pyrolysis process.

Embodiments can include one or more of the following features.

Extracting aromatic petrochemicals from the light fraction includes separating the aromatic petrochemicals of the light fraction from other components of the light fraction by one or more of solvent extraction and extractive distillation.

Extracting aromatic petrochemicals from the light fraction includes converting the light fraction into a reformate in a reformer.

The reformate is rich in aromatic petrochemicals compared to the light fraction.

The method includes separating an output from the reformer into the reformate and a byproduct fraction.

The method includes separating the byproduct fraction into hydrogen and light gases.

The method includes providing the hydrogen to the hydroprocessing zone.

The method includes providing the light gases to the pyrolysis section.

Converting the light fraction into a reformate includes conducting one or more of hydrocracking, isomerization, dehydrocyclization, and dehydrogenation.

The method includes returning the other components of the light fraction to the hydroprocessing process.

Extracting aromatic petrochemicals from the light fraction includes generating an output stream that is rich in aromatics compared to the light fraction.

The method includes separating an input stream of crude oil into a light crude oil fraction and a heavy crude oil fraction, and in which removing impurities from the crude oil includes removing impurities from the heavy crude oil fraction.

The method includes providing the light crude oil fraction to the pyrolysis process.

The method includes separating an effluent from the hydroprocessing process into a gas and the liquid.

The method includes separating a gas output from the hydroprocessing process into hydrogen and light gases.

The method includes providing the hydrogen to the hydroprocessing process.

The method includes providing the light gases to the pyrolysis process.

The method includes removing fuel oil from the heavy fraction before the pyrolysis process.

Cracking the heavy fraction into multiple products includes cracking the heavy fraction into one or more of methane, ethylene, propylene, butadiene, and butane.

The method includes separating the cracked heavy fraction into multiple streams, each stream corresponding to one of the multiple products.

The systems and methods described here can have one or more of the following advantages. The approach to producing aromatics described here is a versatile approach that can produce multiple products, such as both aromatic and olefinic petrochemical products. The production of aromatics such as benzene, xylene, toluene, or other aromatics during the direct conversion of crude oil to petrochemicals can be increased. The direct conversion of crude oil into aromatic and olefinic products can enable complex distillation steps to be bypassed. The systems and methods described here can have reduced coke formation and a reduced production of undesirable byproducts in the steam pyrolysis section.

DETAILED DESCRIPTION

We describe here an integrated hydrotreating and steam pyrolysis approach to directly converting crude oil to petrochemicals, including olefinic petrochemicals such as ethylene, propylene, butylene, and butenes; and aromatic petrochemicals such as benzene, toluene, and xylene. In the approach to converting crude oil to petrochemicals described here, crude oil is processed in a hydroprocessing zone to remove impurities. A portion of the output from the hydroprocessing zone is processed to extract aromatic petrochemicals, and another portion of the output from the hydroprocessing zone is treated in a steam pyrolysis process to crack the portion into multiple olefinic products. The ability to generate aromatic petrochemicals from multiple portions of the output from the hydroprocessing zone, such as both heavy and light fractions of the crude oil, enables a high yield of aromatic petrochemicals to be achieved.

The term crude oil as used here refers to whole crude oil from conventional sources, including crude oil that has undergone some pre-treatment. Crude oil can refer to material that has been subjected to one or more of water-oil separation, gas-oil separation, desalting, and stabilization.

Figure 1:
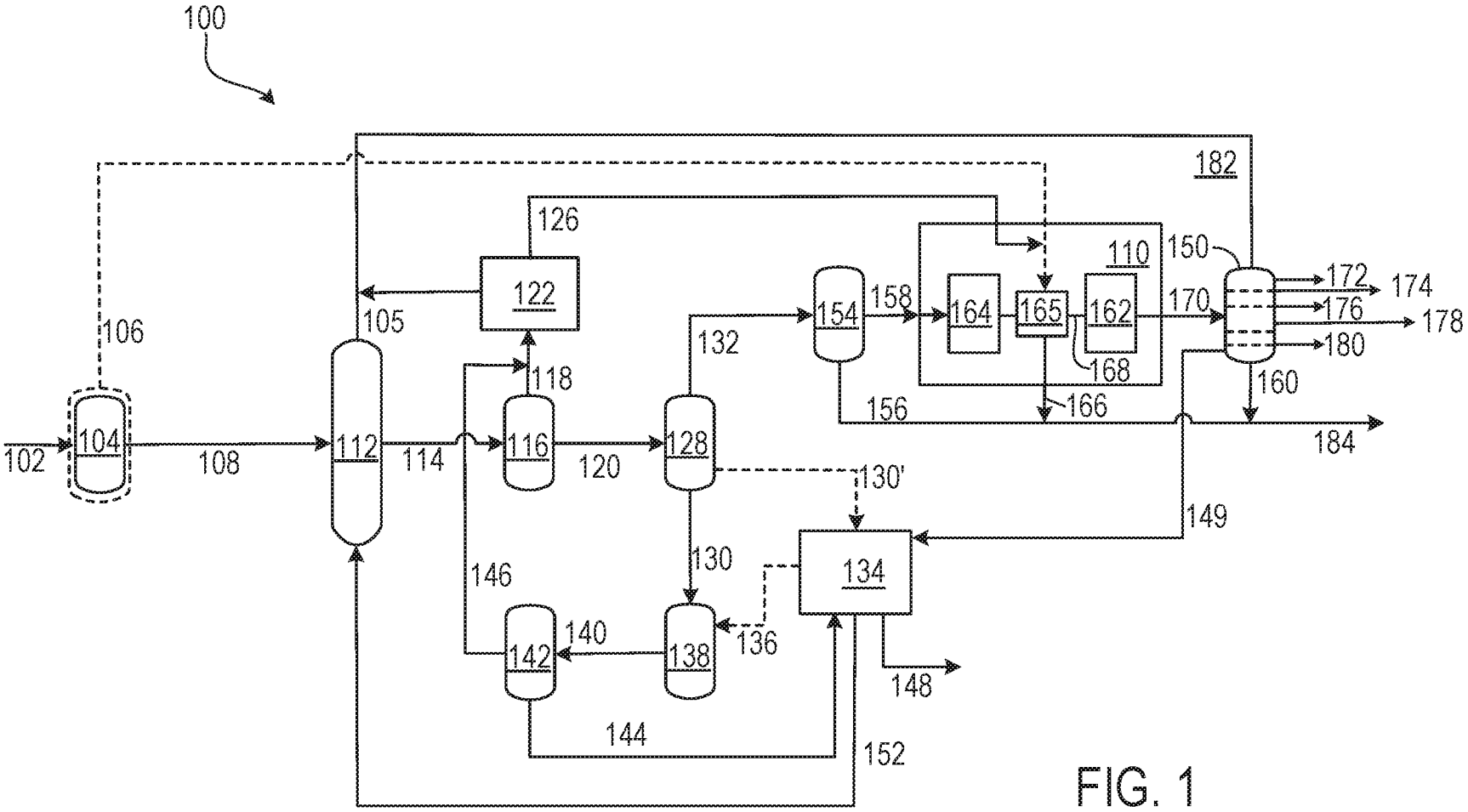
FIG. 1 is a block diagram of a conversion system.

Referring to FIG. 1, a conversion system 100 performs direct conversion of crude oil into petrochemicals, including both olefinic and aromatic petrochemicals. An input stream of crude oil 102 is received into a separation unit 104 of the conversion system 100. The separation unit 104 separates the crude oil 102 into a light fraction 106, such as a gas, and a heavy fraction 108, such as a liquid. In some examples, the light fraction 106 can be a naphtha fraction. In some examples, the light fraction 106 can have a boiling point below about 65° C.

In some examples, the separation unit 104 can be a flash separation device such as a flash drum. For instance, the separation unit 104 can be a single stage separation device such as a flash separator with a cut point between about 150° C. and about 260° C. In some examples, the separation unit 104 can operate in the absence of a flash zone. For instance, the separation unit 104 can include a cyclonic phase separation device, a splitter, or another type of separation device based on physical or mechanical separation of vapors and liquids. In a cyclonic phase separation device, vapor and liquid flow into the device through a cyclonic geometry. The vapor is swirled in a circular pattern to create forces that cause heavier droplets and liquid to be captured and channeled to a liquid outlet. Vapor is channeled to a vapor outlet. The cyclonic separation device operates isothermally and with very low residence time. The cut point of the separation unit 104 can be adjusted based on factors such as the vaporization temperature, the fluid velocity of the material entering the separation unit 104, or both, or other factors. Further description of separation devices can be found in U.S. Patent Publication No. 2011/0247500, the contents of which are incorporated here by reference in their entirety.

The heavy fraction 108 is routed to a hydroprocessing zone 112 for removal of impurities such as sulfur, metals, nitrogen, or other impurities. In some configurations of the conversion system 100, such as that shown in FIG. 1, the light fraction 106 bypasses the hydroprocessing zone 112 and is routed directly to a pyrolysis section 110, where the light fraction 106 can be directly converted to olefins. In some configurations of the conversion system 100, the light fraction 106 is output from the conversion system 100 and used as fuel. In some configurations of the conversion system 100, the separation unit 104 is bypassed or eliminated and the input stream of crude oil 102 is received directly into the hydroprocessing zone 112.

The hydroprocessing zone 112 processes the heavy fraction 108 (or the crude oil 102, if the separation unit 104 is bypassed) along with recycled hydrogen 105 and non-aromatic gases 152 returned from downstream processing. The hydroprocessing zone 112 can carry out one or more of the following processes: hydrodemetallization, hydrodearomatization, hydrodenitrogenation, hydrodesulfurization, and hydrocracking. The hydroprocessing zone 112 can include one or more beds containing an effective amount of hydrodemetallization catalyst. The hydroprocessing zone 112 can include one or more beds containing an effective amount of hydroprocessing catalyst having one or more of hydrodearomatization, hydrodenitrogenation, hydrodesulfurization and hydrocracking functions. In some examples, the hydroprocessing zone 112 can include multiple catalyst beds, such as two, three, four, five, or another number of catalyst beds. In some examples, the hydroprocessing zone 112 can include multiple reaction vessels each containing one or more catalyst beds of the same or different function.

Further description of hydroprocessing zones can be found in United States Patent Publication Number 2011/0083996 and in PCT Patent Application Publication Numbers WO2010/009077, WO2010/009082, WO2010/009089 and WO2009/073436, the contents of all of which are incorporated here by reference in their entirety.

The hydroprocessing zone 112 can operate at a temperature between about 300° C. and about 450° C., such as about 300° C., about 350° C., about 400° C., about 450° C., or another temperature. The hydroprocessing zone 112 can operate at a pressure between about 30 bar and about 180 bar, such as about 30 bar, about 60 bar, about 90 bar, about 120 bar, about 150 bar, about 180 bar, or another pressure. The hydroprocessing zone 112 can operate with a liquid hour space velocity between about 0.1 $h^{-1}$ and about 10 $h^{-1}$, such as about 0.1 $h^{-1}$, about 0.5 $h^{-1}$, about 1 $h^{-1}$, about 2 $h^{-1}$, about 4 $h^{-1}$, about 6 $h^{-1}$, about 8 $h^{-1}$, about 10 $h^{-1}$, or another liquid hour space velocity. The liquid hour space velocity is the ratio of the flow rate of a reactant liquid through a reactor to the volume of the reactor.

A hydroprocessed effluent 114 is output from the hydroprocessing zone 112 and directed to a separation unit 116, such as a high pressure cold or hot separator. In some examples, the effluent 114 can be cooled in a heat exchanger (not shown) prior to the separation unit 116. The separation unit 116 separates the hydroprocessed effluent 114 into separator tops 118, which are generally gases, and separator bottoms 120, which are substantially liquid. In some examples, the separation unit 116 can be a flash separation device such as a flash drum. In some examples, the separation unit 116 can operate in the absence of a flash zone. For instance, the separation unit 116 can include a cyclonic phase separation device, a splitter, or another type of separation device based on physical or mechanical separation of vapors and liquids.

The separator tops 118 are routed to a gas separation and purification unit 122. The gas separation and purification unit 122 can include an amine component that purifies the separator tops 118 and a separation component that separates the separator tops 118 into hydrogen gas 124 and light gases 126, such as C1-C5 hydrocarbon gases, hydrogen sulfide, ammonia, or other light gases. The hydrogen gas 124 is recycled to the hydroprocessing zone 112. In some examples (not shown), the hydrogen gas 124 can be compressed in a compressor prior to being returned to the hydroprocessing zone 112. In some examples, such as shown in FIG. 1, the light gases 126 can be directed to the pyrolysis section 110 for production of olefins. In some examples (not shown), the light gases 126 can be recycled to the hydroprocessing zone 112 or output from the conversion system 110 for use as fuel gas or liquefied petroleum gas (LPG).

The separator bottoms 120, which contain the heavy bottoms of the hydroprocessed effluent 114, contain a reduced content of contaminants, such as metals, sulfur, or nitrogen; an increased paraffinicity; a reduced BMCI (Bureau of Mines Correlation Index); and an increased API (American Petroleum Institute) gravity as compared to the heavy fraction 108 of crude oil input into the hydroprocessing zone 112. The separator bottoms 120 are directed to a separation unit 128. In some examples, the separator bottoms 120 can be cooled in a heat exchanger (not shown) prior to the separation unit 128, which separates the separator bottoms 120 into a light fraction 130 and a heavy fraction 132. In some examples, the separation unit 128 can be a flash separation device such as a flash drum. In some examples, the separation unit 128 can operate in the absence of a flash zone. For instance, the separation unit 128 can include a cyclonic phase separation device, a splitter, or another type of separation device based on physical or mechanical separation of vapors and liquids. The separation unit 128 can include one or more separation devices that are able to fractionate a hydrocarbon cut similar to naphtha range and broader, such as a hydrocarbon cut that is rich in aromatic precursors.

The light fraction 130 from the separation unit 128 includes hydrocarbon that was previously desulfurized and treated by the hydroprocessing zone 112. For instance, the light fraction 130 can include naphtha. The light fraction 130 can include hydrocarbon having an initial boiling point and a final boiling point of between about 150° C. and about 230° C., such as about 150° C., about 160° C., about 170° C., about 180° C., about 190° C., about 200° C., about 210° C., about 220° C., about 230° C., or another temperature. The heavy fraction 132 can include hydrocarbon having an initial boiling point between about 150° C. and about 230° C., such as about 150° C., about 160° C., about 170° C., about 180° C., about 190° C., about 200° C., about 210° C., about 220° C., about 230° C., or another temperature; and a final boiling point of 540° C. or higher. The initial and final boiling points of the light fraction 130, the heavy fraction 132, or both can depend on the type of crude oil 102 input into the conversion system 100.

In some cases, the light fraction 130 from the separation unit 128 is routed to a reformer 138, such as a naphtha reforming unit. In some cases, such as if the aromatic content of the light fraction is significant, the light fraction can be routed along an alternate path 130' to an aromatic extraction unit 134, discussed in greater detail infra, and an aromatic stream 136 output from the aromatic extraction unit 134 can be routed to the reformer 138. Because the light fraction 130 was treated in the hydroprocessing zone 112 upstream of the reformer 138, no hydrotreating of the light fraction 130 is performed before the light fraction 130 is fed into the reformer 138. The reformer 138, also discussed in greater detail infra, converts the light fraction 130 into a reformate that is rich in diverse aromatics, such as benzene, toluene, and xylene. In some examples, the reformer 138 enables a high production of xylene at the expense of a lower production of benzene. The reformer 138 can also produce hydrocarbon byproducts such as hydrogen gas and light hydrocarbon gases. The purposeful generation of aromatics by treating the light fraction 130 in the reformer 138 enables the overall yield of aromatics from the conversion system 100 to be increased.

An output stream 140 from the reformer 138, which contains the reformate and byproducts, is fed into a separation unit 142. In some examples, the separation unit 142 can be a flash separation device such as a flash drum. In some examples, the separation unit 142 can operate in the absence of a flash zone. For instance, the separation unit 142 can include a cyclonic phase separation device, a splitter, or another type of separation device based on physical or mechanical separation of vapors and liquids. The separation unit 142 separates the output stream 140 from the reformer 138 into a liquid stream 144 including the liquid reformate and a gas stream 146 including the hydrocarbon byproducts from the reformer 138, such as hydrogen gas and light hydrocarbon gases. The liquid stream 144 is routed to the aromatic extraction unit 134. The gas stream 146 is sent to the purification device 122 for separation into hydrogen 124 and light hydrocarbon gases 126.

The reformer 138 uses reactions such as one or more of hydrocracking, isomerization, dehydrocyclization, and dehydrogenation, to convert the light fraction 130 and the aromatic stream 136 into a reformate that is rich in aromatics such as benzene, toluene, and xylene. The reformer 138 can also generate hydrocarbon byproducts such as hydrogen and light hydrocarbon gases. The reformer can include a catalyst that is compatible with catalytic processes that maximize production of aromatics. For instance, the catalyst can be a mono- or bi-functional metal catalyst (for instance, one or more of platinum, palladium, rhenium, tin, gallium, bismuth, or other metal catalysts), a halogen containing catalyst, a catalyst employing a zeolite such as zeolite L or a ZSM-5 zeolite, a catalyst employing a crystalline or amorphous support that is mesoporous or microporous (for instance, an alumina, silica, or alumina silica support), or another type of catalyst that can maximize aromatics production. Examples of appropriate catalysts are described in U.S. Pat. No. 5,091,351 and PCT Patent Application Publication Number WO 2000/009633, the contents of both of which are incorporated here by reference in their entirety.

The operating conditions of the reformer 138 can be selected to maximize aromatics production. The reformer 138 can operate at a pressure between about 0.01 bar and about 50 bar, such as about 0.01 bar, about 0.1 bar, about 0.5 bar, about 1 bar, about 5 bar, about 10 bar, about 20 bar, about 30 bar, about 40 bar, about 50 bar, or another pressure. The molar ratio of hydrogen to hydrocarbon in the reformer 138 can be between about 1:1 and about 10:1, such as about 1:1, about 2:1, about 4:1, about 6:1, about 8:1, about 10:1, or another ratio. The reformer 138 can operate at a temperature between about 400° C. and about 600° C., such as about 400° C., about 450° C., about 500° C., about 550° C., about 600° C., or another temperature. The reformer can operate with a liquid hour space velocity between about 0.1 $h^{-1}$ and about 5 $h^{-1}$, such as about 0.1 $h^{-1}$, about 0.5 $h^{-1}$, about 1 $h^{-1}$, about 2 $h^{-1}$, about 3 $h^{-1}$, about 4 $h^{-1}$, about 5 $h^{-1}$, or another liquid hour space velocity.

The aromatic extraction unit 134 separates aromatics from reformate and pyrolysis gasoline using extraction techniques such as solvent extraction, extractive distillation, or other extraction techniques. The aromatic extraction unit 134 receives the liquid stream 144 including reformate from the separation unit 142, pyrolysis gasoline 149 from a product purification unit 150, discussed infra, and optionally the light fraction 130' from the separation unit 128, and produces an enriched aromatics stream 148 that is rich in aromatics such as one or more of benzene, toluene, and xylene. The enriched aromatics stream 148 can be purified and collected by components external to the conversion system 100. Non-aromatics 152 exiting the aromatic extraction unit 134 can be recycled to the hydroprocessing zone 112 for further processing.

Returning to the separation unit 128, the heavy fraction 132 is fed into a separation unit 154. In the separation unit 154, the heavy fraction 132 is fractioned into a fuel oil fraction 156 including heavy components and a vapor fraction 158 including light components. The fuel oil fraction 156 can be combined with pyrolysis fuel oil 160 from the product purification unit 150 and output from the conversion system 100 as a fuel oil blend. In some examples, the separation unit 154 can be a flash separation device such as a flash drum. In some examples, the separation unit 154 can operate in the absence of a flash zone. For instance, the separation unit 154 can include a cyclonic phase separation device, a splitter, or another type of separation device based on physical or mechanical separation of vapors and liquids.

The vapor fraction 158 from the separation unit 128 is routed to the pyrolysis section 110. The vapor fraction 158 can have an initial boiling point corresponding to the initial boiling point of the separator bottoms 120 and a final boiling point between about 370° C. and about 600° C. In the pyrolysis section 110, a steam pyrolysis unit 162 cracks the vapor fraction 158 and the light gases 126 from the gas separation and purification unit 122 into multiple products, such as one or more of ethylene, propylene, butadiene, mixed butenes, and pyrolysis gasoline, in the presence of steam. In some examples, such as shown in FIG. 1, the pyrolysis section 110 can include a heating component 164 that heats the vapor fraction 158 prior to cracking in the steam pyrolysis unit 162. For instance, the heating component 164 can include a convection unit that heats the vapor fraction 158 in the presence of steam. In some examples, the heating component 164 is not included in the pyrolysis section 110.

The steam pyrolysis unit 162 and the heating component 164 can operate at a temperature between about 400° C. and about 900° C., such as about 400° C., about 500° C., about 600° C., about 700° C., about 800° C., about 900° C., or another temperature. The steam pyrolysis unit 162 and the heating component 164 can each operate with a residence time between about 0.05 seconds and about 2 seconds, such as about 0.05 seconds, about 0.1 seconds, about 0.5 seconds, about 1 seconds, about 1.5 seconds, about 2 seconds, or another residence time. When the heating component 164 is implemented as a convection unit, the steam-to-hydrocarbon ratio in the convection unit can be between about 0.3:1 to about 2:1 by weight, such as about 0.3:1, about 0.5:1, about 1:1, about 1.5:1, about 2:1, or another ratio.

In some examples, the pyrolysis section 110 can include a vapor-liquid separation unit 165 that removes any remaining liquid components 166 from the vapor fraction 158 and sends vapor components 168 to the steam pyrolysis unit 162. The removed liquid components 166 can be rejected as a fuel oil component to be combined with pyrolysis fuel oil 160 from the product purification unit 150. The vapor-liquid separation unit 165 can include one or more vapor liquid separation devices, such as the devices described in U.S. Pat. No. 9,255,230, the contents of which are incorporated by reference here in their entirety. In some examples, the vapor-liquid separation unit 165 is not included in the pyrolysis section 110.

A product stream 170 containing the multiple products is passed from the pyrolysis section 110 to the product purification unit 150. In some examples, the product stream 170 can be cooled prior to processing in the product purification unit 150. For instance, the product stream 170 can be quenched with a quenching solution, compressed in a compressor, dehydrated, or a combination of multiple of these processes.

The product purification unit 150 separates the product stream 168 from the pyrolysis section 110 into its constituent components, such as one or more of methane, ethylene, propylene, butadiene, mixed butylenes, and pyrolysis gasoline, discharged as streams 172, 174, 176, 178, 180, 149, respectively. For instance, the product purification unit 150 can include a de-methanizer tower that produces hydrogen and methane. The product purification unit 150 can also include de-ethanizer, de-propanizer, and de-butanizer towers to produce the ethylene, propylene, butadiene, and mixed butylenes. Hydrogen 182 produced by the product purification unit 150 can be recycled back to the hydroprocessing zone 112, in some cases following a purification process. The pyrolysis gasoline 149 is returned to the aromatic extraction unit 134 for extraction of any remaining aromatics. Although six product streams are shown in the example of FIG. 1, more or fewer product streams can be produced by the product purification unit 150, for instance, depending on the arrangement of separation units employed by the product purification unit 150 or the target yield or distribution for the product purification unit 150.

Pyrolysis fuel oil 160 remaining after the separation of the product stream 168 into its constituent components, which generally includes C5-C9 hydrocarbons, can be combined with the fuel oil fraction 156 from the separation unit 154 and removed as a pyrolysis fuel oil blend 184, such as a low sulfur fuel oil blend, for instance, for further processing in an off-site refinery. Because the fuel oil fraction 156 and the pyrolysis fuel oil 160 have been subjected to the selective hydroprocessing of the hydroprocessing zone 112, the pyrolysis fuel oil blend 184 contains a reduced amount of heteroatom compounds such as sulfur-containing, nitrogen-containing, or metal compounds compared to the crude oil 102 input into the conversion system 100. This composition of the pyrolysis fuel oil blend 184 facilitates further processing of the blend 182 or can render the blend 184 useful as a low sulfur, low nitrogen, heavy fuel blend.

In some examples, selective hydroprocessing or hydrotreating processes can increase the paraffin content (or decrease the BMCI) of a feedstock (for instance, the heavy fraction 108 of the crude oil input stream 102) by saturation followed by mild hydro cracking of aromatics, especially polyaromatics. When hydrotreating a crude oil, contaminants such as metals, sulfur and nitrogen can be removed by passing the feedstock through a series of layered catalysts that perform the catalytic functions of one or more of demetallization, desulfurization, and denitrogenation. In some examples, the sequence of catalysts to perform hydrodemetallization (HDM) and hydrodesulfurization (HDS) can include a hydrodemetallization catalyst, an intermediate catalyst, a hydrodesulfurization catalyst, and a final catalyst.

The catalyst in the HDM section can be based on a gamma alumina support, with a surface area of between about 140 $m^2/g$ and about 240 $m^2/g$. This catalyst has a very high pore volume, such as a pore volume in excess of about 1 $cm^3/g$. The pore size can be predominantly macroporous, which provides a large capacity for the uptake of metals on the surface of the catalyst, and optionally dopants. The active metals on the catalyst surface can be sulfides of nickel (Ni), molybdenum (Mo), or both, with a molar ratio of Ni:(Ni+Mo) of less than about 0.15. The concentration of nickel is lower on the HDM catalyst than other catalysts as some nickel and vanadium is anticipated to be deposited from the feedstock itself, thus acting as a catalyst. The dopant can be one or more of phosphorus, boron, silicon and halogens, for instance, as described in U.S. Patent Publication Number US 2005/0211603, the contents of which are incorporated by reference here in their entirety. In some examples, the catalyst can be in the form of alumina extrudates or alumina beads. For instance, alumina beads can be used to facilitate un-loading of the catalyst HDM beds in the reactor as the metal can uptake will range between from 30 to 100% at the top of the bed.

An intermediate catalyst can be used to perform a transition between the hydrodemetallization and hydrodesulfurization functions. The intermediate catalyst can have intermediate metal loadings and pore size distribution. The catalyst in the HDM/HDS reactor can be an alumina based support in the form of extrudates, at least one catalytic metal from group VI (for instance, molybdenum, tungsten, or both), or at least one catalytic metals from group VIII (for instance, nickel, cobalt, or both), or a combination of any two or more of them. The catalyst can contain at least one dopant, such as one or more of boron, phosphorous, halogens, and silicon. The intermediate catalyst can have a surface area of between about 140 $m^2/g$ and about 200 $m^2/g$, a pore volume of at least about 0.6 $cm^3/g$, and mesoporous pores sized between about 12 nm and about 50 nm.

The catalyst in the HDS section can include gamma alumina based support materials with a surface area towards the higher end of the HDM range, such as between about 180 $m^2/g$ and about 240 $m^2/g$. The higher surface for the HDS catalyst results in relatively smaller pore volume, such as a pore volume of less than about 1 $cm^3/g$. The catalyst contains at least one element from group VI, such as molybdenum, and at least one element from group VIII, such as nickel. The catalyst also contains at least one dopant, such as one or more of boron, phosphorous, silicon, and halogens. In some examples, cobalt (Co) can be used to provide relatively higher levels of desulfurization. The metals loading for the active phase is higher as the desired activity is higher, such that the molar ratio of Ni:(Ni+Mo) is between about 0.1 and about 0.3 and the molar ratio of (Co+Ni):Mo is between about 0.25 and about 0.85.

A final catalyst can perform hydrogenation of the feedstock rather than having a primary function of hydrodesulfurizaiton. In some examples, the final catalyst can replace the intermediate catalyst and the catalyst in the HDS section. The final catalyst can be promoted by nickel and the support can be wide pore gamma alumina. The final catalyst can have a surface area towards the higher end of the HDM range, such as between about 180 $m^2/g$ and about 240 $m^2/g$. The higher surface area for the final catalyst results in relatively smaller pore volume, such as a pore volume of less than about 1 $cm^3/g$.

Figure 2:
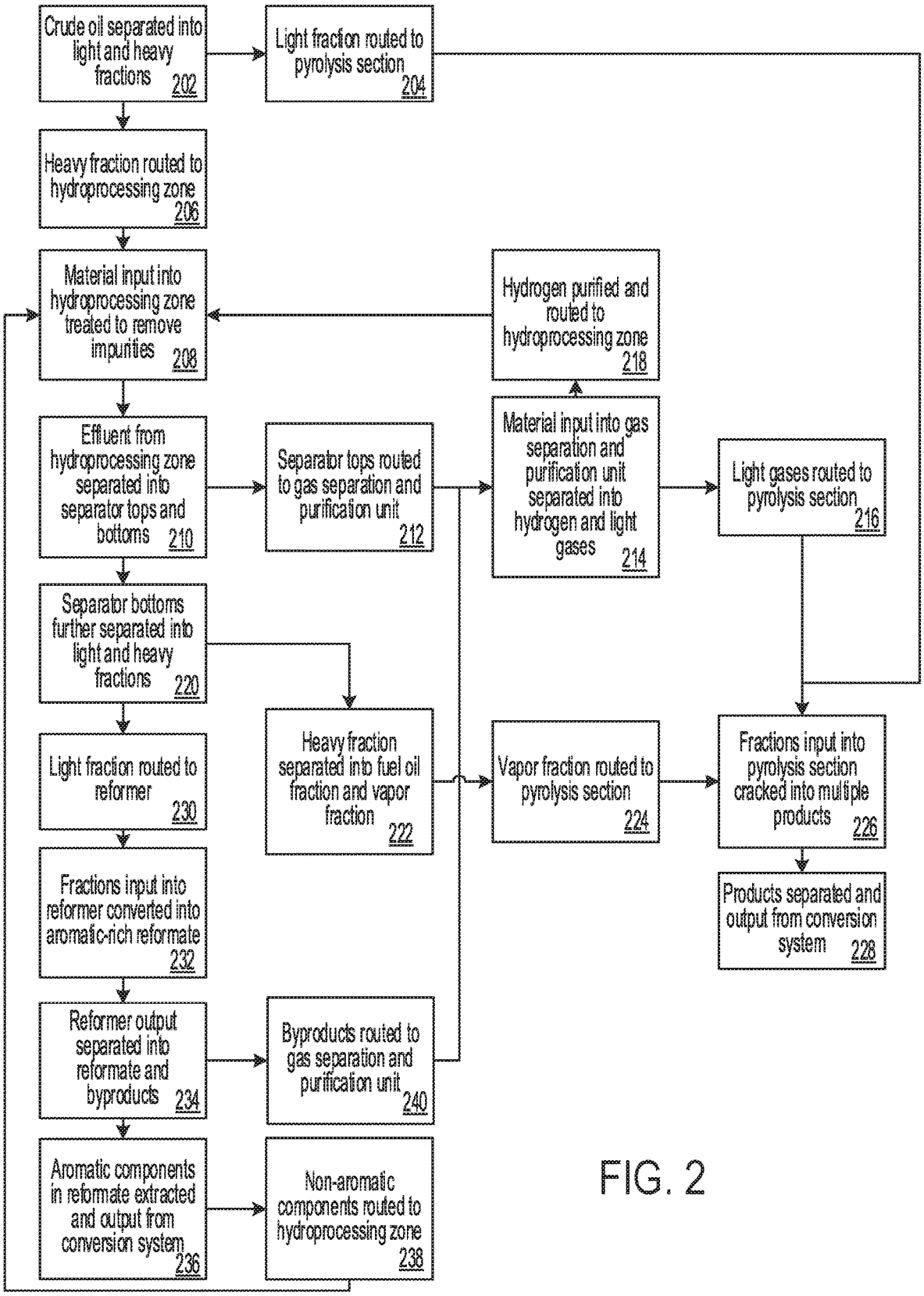
FIG. 2 is a flow chart.

Referring to FIG. 2, in an example process for converting crude oil to petrochemicals, crude oil is separated into a light fraction, such as a gas, and a heavy fraction, such as a liquid (202). The light fraction is routed to a pyrolysis section (204) for generation of olefins. The heavy fraction is routed to a hydroprocessing zone (206) and treated to remove impurities such as sulfur, metals, nitrogen, or other impurities (208).

A hydroprocessed effluent from the hydroprocessing zone is separated into separator tops, which are generally gases, and separator bottoms, which are substantially liquid (210). The separator tops are routed to a gas separation and purification unit (212) and separated into hydrogen gas and light gases, such as C1-C5 hydrocarbon gases (214). The light gases are routed to the pyrolysis section (216) for generation of olefins. The hydrogen is purified and recycled to the hydroprocessing zone (218).

The separator bottoms of the hydroprocessed effluent are further separated into a light fraction and a heavy fraction (220). The heavy fraction is further separated into a fuel oil fraction and a vapor fraction (222). The vapor fraction is routed to the pyrolysis section (224). The fractions input into the pyrolysis section are cracked into multiple products, such as one or more of ethylene, propylene, butadiene, mixed butenes, and pyrolysis gasoline (226). The products are separated and output from the conversion system (228).

The light fraction of the separator bottoms are routed to a reformer (230). The components input into the reformer are converted into a reformate that is rich in aromatics, such as benzene, toluene, and xylene (232). The reformate is separated from byproducts generated by the reformer (234). Aromatic components in the reformate are extracted and output from the conversion system (236). Non-aromatic components in the reformate are recycled to the hydroprocessing zone (238). Byproducts generated by the reformer are routed to the gas separation and purification unit (240).

Other implementations are also within the scope of the following claims.

What is claimed is:

1. A method comprising:

separating an input stream of crude oil into outputs consisting of a light fraction and a heavy fraction in a crude separation unit;

removing impurities from by the heavy fraction in a hydroprocessing zone;

separating a hydroprocessed effluent from the hydroprocessing zone into separator tops and separator bottoms in a first separation unit;

extracting aromatic petrochemicals from the separator tops in an aromatic extraction subsystem before feeding the separator tops to a reformer; and cracking the separator bottoms into multiple olefinic products in a pyrolysis section.

2. The method of claim 1, in which extracting the aromatic petrochemicals from the separator tops comprises separating the aromatic petrochemicals of the separator tops from other components of the separator tops by one or more of solvent extraction and extractive distillation.

3. The method of claim 2, in which extracting the aromatic petrochemicals from the separator tops comprises converting the separator tops into a reformate in a reformer.

4. The method of claim 3, in which the reformate is rich in aromatic petrochemicals compared to the separator tops.

5. The method of claim 4, comprising separating an output from the reformer into the reformate and a byproduct fraction.

6. The method of claim 5, comprising separating the byproduct fraction into hydrogen and light gases.

7. The method of claim 6, comprising providing the hydrogen to the hydroprocessing zone.

8. The method of claim 6, comprising providing the light gases to the pyrolysis section.

9. The method of claim 3, in which converting the separator tops into a reformate comprises conducting one or more of hydrocracking, isomerization, dehydrocyclization, and dehydrogenation.

10. The method of claim 2, comprising returning the other components of the separator tops to the hydroprocessing process.

11. The method of claim 2, in which extracting the aromatic petrochemicals from the separator tops comprises generating an output stream that is rich in aromatics compared to the separator tops.

12. The method of claim 1, comprising providing the light fraction to the pyrolysis section.

13. The method of claim 1, comprising separating the separator tops into hydrogen and light gases.

14. The method of claim 13, comprising providing the hydrogen to the hydroprocessing process.

15. The method of claim 13, comprising providing the light gases to the pyrolysis section.

16. The method of claim 1, comprising removing fuel oil from the separator bottoms before the pyrolysis section.

17. The method of claim 1, in which cracking the separator bottoms into multiple products comprises cracking the separator bottoms into one or more of methane, ethylene, propylene, butadiene, and butane.

18. The method of claim 1, comprising separating the cracked separator bottoms into multiple streams, each stream corresponding to a product.

* * * * *